US011302233B2

(12) United States Patent
Yang et al.

(10) Patent No.: US 11,302,233 B2
(45) Date of Patent: Apr. 12, 2022

(54) TIMING CONTROL METHOD AND TIMING CONTROL CIRCUIT FOR DISPLAY PANEL, DRIVING DEVICE AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventors: Yan Yang, Beijing (CN); Rui Liu, Beijing (CN); Wei Sun, Beijing (CN); Ming Chen, Beijing (CN); Xue Dong, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/255,070

(22) PCT Filed: May 26, 2020

(86) PCT No.: PCT/CN2020/092296

§ 371 (c)(1),
(2) Date: Dec. 22, 2020

(87) PCT Pub. No.: WO2020/244418

PCT Pub. Date: Dec. 10, 2020

(65) Prior Publication Data

US 2021/0174723 A1 Jun. 10, 2021

(30) Foreign Application Priority Data

Jun. 6, 2019 (CN) ..... 201910491275.2

(51) Int. Cl.
*G09G 3/20* (2006.01)

(52) U.S. Cl.
CPC ..... *G09G 3/20* (2013.01); *G09G 2310/08* (2013.01)

(58) Field of Classification Search
CPC ..... G09G 3/20; G09G 2310/08
See application file for complete search history.

(56) References Cited

U.S. PATENT DOCUMENTS 7,298,368 B2 * 11/2007 Anderson ..... G09G 3/20 345/205
10,074,327 B2 * 9/2018 Seo ..... G09G 3/3614
(Continued)

FOREIGN PATENT DOCUMENTS

CN 1983362 A 6/2007
CN 101071545 A 11/2007
(Continued)

OTHER PUBLICATIONS

Office Action dated Jul. 5, 2021 issued in corresponding Chinese Application No. 201910491275.2.

*Primary Examiner* — Sejoon Ahn
(74) *Attorney, Agent, or Firm* — Nath, Goldberg & Meyer; Joshua B. Goldberg

(57) ABSTRACT

The disclosure provides a timing control method and a timing control circuit for a display panel, a driving device, and a display device. The method includes: in respective display periods, supplying a data enable signal to a source driving circuit. The source driving circuit supplies a data signal to a plurality of sub-display regions under the control of the data enable signal. The data enable signal is switched between an active level and an inactive level, and the active levels of the data enable signal are in one-to-one correspondence with the plurality of sub-display regions of the display panel. The farther one of the plurality of sub-display regions from the source driving circuit, the longer time period, at an active level, of the data enable signal for controlling the
(Continued)

source driving circuit to provide the data signal to at least one row of pixels in the sub-display region is.

17 Claims, 3 Drawing Sheets

(56) References Cited

U.S. PATENT DOCUMENTS

| | | | | |
|---|---|---|---|---|
| 10,504,472 | B2 * | 12/2019 | Dai | G09G 3/3688 |
| 11,049,474 | B2 * | 6/2021 | Kim | G09G 5/10 |
| 2001/0017618 | A1 * | 8/2001 | Azami | G09G 3/3291 345/204 |
| 2008/0165102 | A1 * | 7/2008 | Tsai | G09G 3/3413 345/88 |
| 2008/0303765 | A1 * | 12/2008 | Nakatsuka | G09G 3/3677 345/87 |
| 2009/0109132 | A1 | 4/2009 | Pan et al. | |
| 2010/0220089 | A1 * | 9/2010 | Peng | G09G 3/3614 345/211 |
| 2010/0315321 | A1 * | 12/2010 | Huang | G09G 3/3659 345/92 |
| 2015/0262529 | A1 | 9/2015 | Lee et al. | |
| 2015/0379940 | A1 * | 12/2015 | Kishi | G09G 3/3283 345/690 |
| 2016/0042713 | A1 | 2/2016 | Sim et al. | |
| 2016/0210930 | A1 * | 7/2016 | Lee | G09G 3/3266 |
| 2016/0314738 | A1 * | 10/2016 | Shiohara | H04N 5/23293 |

FOREIGN PATENT DOCUMENTS

| | | | |
|---|---|---|---|
| CN | 102881254 | A | 1/2013 |
| CN | 104361878 | A | 2/2015 |
| CN | 105489185 | A | 4/2016 |
| CN | 105629539 | A | 6/2016 |
| CN | 106875905 | A | 6/2017 |
| CN | 107045858 | A | 8/2017 |
| CN | 108172187 | A | 6/2018 |
| CN | 109192161 | A | 1/2019 |
| CN | 109509446 | A | 3/2019 |
| CN | 109559672 | U | 4/2019 |
| CN | 109686290 | A | 4/2019 |
| KR | 10-2018-0039232 | A | 4/2018 |

* cited by examiner

TIMING CONTROL METHOD AND TIMING CONTROL CIRCUIT FOR DISPLAY PANEL, DRIVING DEVICE AND DISPLAY DEVICE

CROSS-REFERENCE TO RELATED APPLICATIONS

This is a National Phase Application filed under 35 U.S.C. 371 as a national stage of PCT/CN2020/092296, filed May 26, 2020, an application claiming the benefit of Chinese Application No. 201910491275.2, filed Jun. 6, 2019, the content of each of which is hereby incorporated by reference in its entirety.

TECHNICAL FIELD

The present disclosure relates to the field of display technologies, and in particular, to a timing control method and a timing control circuit for a display panel, a driving device, and a display device.

BACKGROUND

As a size of the display panel increases, the non-uniform charging of pixels at different positions becomes more and more serious. The pixels proximal to the source driving circuit are charged sufficiently, and the pixels far from the source driving circuit are charged insufficiently.

SUMMARY

As an aspect, a timing control method for a display panel is provided. A display region of the display panel is divided into a plurality of sub-display regions arranged along a first direction distal to a source driving circuit and extending along a second direction intersecting the first direction. Each of the plurality of sub-display regions includes at least one row of pixels. The timing control method includes supplying a data enable signal to the source driving circuit in respective display periods. The source driving circuit supplies a data signal to the plurality of sub-display regions under the control of the data enable signal. The data enable signal is switched between an active level and an inactive level. The active levels of the data enable signal are in one-to-one correspondence with the plurality of sub-display regions of the display panel. The greater a distance from one of the plurality of sub-display regions to the source driving circuit, the longer a time period, at an active level, of the data enable signal for controlling the source driving circuit to provide the data signal to the at least one row of pixels in the sub-display region is.

In an embodiment, each of the time periods of the data enable signal at an active level every time in respective display periods is calculated according to a preset correspondence between the time periods of the data enable signal at an active level and numbers of the plurality of sub-display regions.

In an embodiment, after the preset correspondence is fitted by a best approximation method, the fitted preset correspondence satisfies a parabolic equation.

In an embodiment, time periods of the data enable signal at an inactive level every time are equal to each other.

In an embodiment, each of the plurality of sub-display regions includes 30 to 1000 rows of pixels.

In an embodiment, each of the plurality of sub-display regions includes only one row of pixels.

As another aspect, a timing control circuit for a display panel is provided. A display region of the display panel is divided into a plurality of sub-display regions arranged along a first direction distal to a source driving circuit and extending along a second direction intersecting the first direction, and each of the plurality of sub-display regions includes at least one row of pixels. The timing control circuit includes an enable signal generation circuit configured to supply a data enable signal to the source driving circuit in respective display periods. The source driving circuit supplies a data signal to the plurality of sub-display regions under control of the data enable signal. The data enable signal is switched between an active level and an inactive level. The active levels of the data enable signal are in one-to-one correspondence with the plurality of sub-display regions of the display panel. The farther a distance from one of the plurality of sub-display regions to the source driving circuit, the longer a time period, at an active level, of the data enable signal for controlling the source driving circuit to provide the data signal to the at least one row of pixels in the sub-display region is.

In an embodiment, the timing control circuit further includes a calculating circuit configured to calculate the time periods of the data enable signal at an active level every time in the respective display periods according to a preset correspondence between the time periods of the data enable signal at an active level and numbers of the plurality of sub-display regions.

In an embodiment, after the preset correspondence is fitted by a best approximation method, the fitted preset correspondence satisfies a parabolic equation.

In an embodiment, time periods of the data enable signal at an inactive level every time are equal to each other.

In an embodiment, each of the plurality of sub-display regions includes 30 to 1000 rows of pixels.

In an embodiment, each of the plurality of sub-display regions includes only one row of pixels.

As yet another aspect, a driving device including the timing control circuit described above is provided.

As yet another aspect, a display device including the driving device described above is provided.

BRIEF DESCRIPTION OF THE DRAWINGS

The accompanying drawings, which provide a further understanding of the present disclosure and constitute a part of the specification, are used in conjunction with the following specific embodiments to explain the present disclosure, but are not intended to limit the present disclosure. In the drawings:

FIGS. 2-1 and 2-2 are schematic diagrams showing a relationship between a data enable signal and a display screen according to an embodiment of the present disclosure;

DETAILED DESCRIPTION

The embodiments of the present disclosure will be described in detail below with reference to the accompanying drawings. It is to be understood that the embodiments described herein are merely used for describing and explaining the present disclosure, rather than limiting of the present disclosure.

When the display panel is driven to display, during respective display periods, a timing control circuit (TCON) supplies a frame starting signal to a gate driving circuit, and then the gate driving circuit supplies a scanning signal to pixel units row by row; and the timing control circuit supplies a data enable signal (DE signals for short, and also called an active data strobe signal) to a source driving circuit. The data enable signal is a square-wave signal switching between a high level and a low level. The respective display periods of the data enable signal respectively correspond to the sub-display regions each including a plurality of rows of pixels, and the source driving circuit outputs an active data signal to a respective sub-display region when the data enable signal is at a high level. Alternatively, the respectively display periods of the data enable signal respectively correspond to row periods, and the source driving circuit outputs the active data signal to a respective row of pixels when the data enable signal is at a high level.

When the size of the display panel is large, a voltage drop (i.e., IR drop) on the data line is large, resulting in that the pixels away from the source driving circuit are charged insufficiently and the pixels proximal to the source driving circuit are charged sufficiently, and in turn resulting in uneven display.

Figure 1:
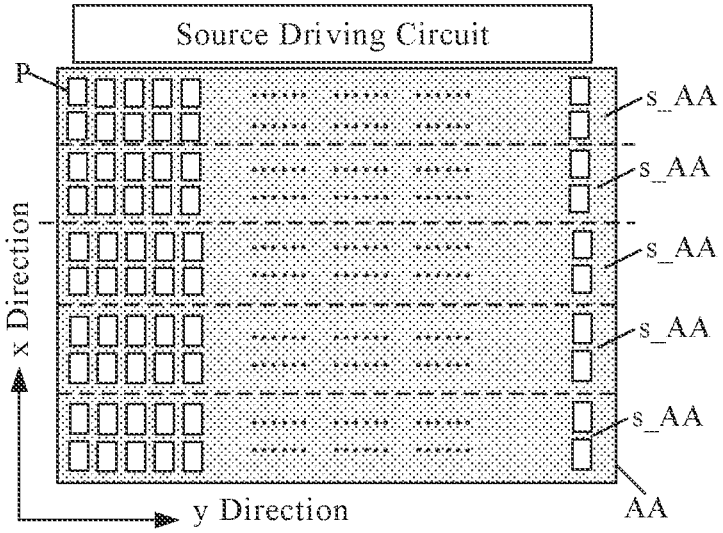
FIG. 1 is a schematic diagram showing region division of a display region of a display panel according to an embodiment of the present disclosure.

An embodiment of the present disclosure provides a timing control method for a display panel. FIG. 1 is a schematic view showing region division of a display region of a display panel according to an embodiment of the present disclosure. As shown in FIG. 1, the display region AA of the display panel is divided into a plurality of sub-display regions s_AA arranged along an x direction away from the source driving circuit and extending along a y direction intersecting, e.g., perpendicular to, the x direction, and each of the sub-display regions s_AA includes at least one row of pixels P. The timing control method includes supplying a data enable signal to the source driving circuit during respective display periods.

Figures 1, 2:
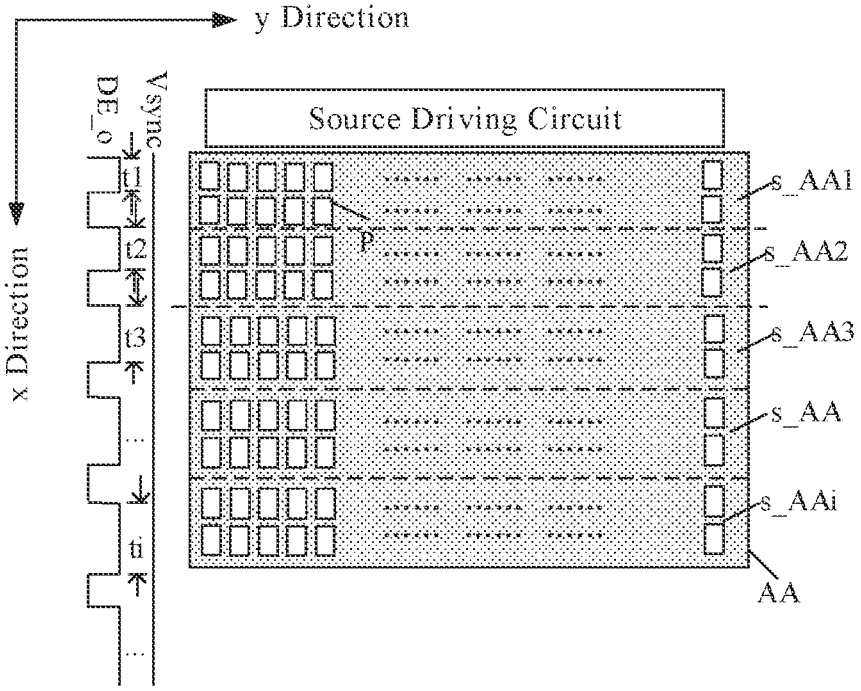
Figure 2:
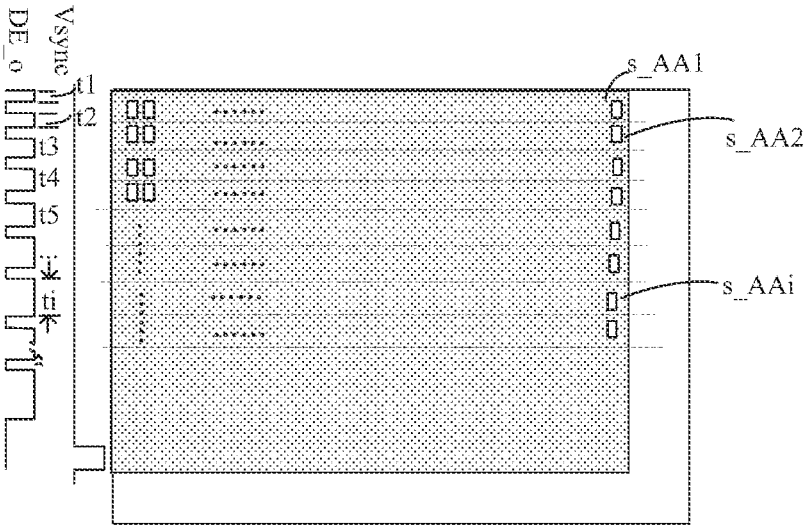

FIGS. 2-1 and 2-2 are schematic diagrams showing a relationship between a data enable signal and a display screen according to an embodiment of the present disclosure. As shown in FIG. 2-1, the data enable signal DE_o is switched between an active level and an inactive level, the active levels are in one-to-one correspondence with the sub-display regions, and the duration of the active level increases with an increased distance from the sub-display region s_AA where a respective row of pixels are located to the source driving circuit.

In the case where each of the sub-display regions includes only one row of pixels, as shown in FIG. 2-2, the data enable signal DE_o switches between an active level and an inactive level, the active levels are in one-to-one correspondence with the rows of pixels, and a duration of the active level increases as a distance from a respective row of pixels to the source driving circuit increases.

The source driving circuit supplies an active data signal to the rows of pixels P in the sub-display regions when the data enable signal DE_o is at an active level. The gate driving circuit supplies a scanning signal to the rows of pixels P row by row from a side proximal to the source driving circuit to a side away from the source driving circuit when supplying the scanning signal. Therefore, when the data enable signal DE_o is at an active level for the $i^{th}$ time in a respective display period, the source driving circuit supplies an active data signal to the $i^{th}$ sub-display region. Optionally, the active level is a high level, and the inactive level is a low level.

As shown in FIG. 2-1, a first sub-display region s_AA1, a second sub-display region s_AA2, a third sub-display region s_AA3 to an $i^{th}$ sub-display region s_AA1 are sequentially arranged along the x direction away from the source driving circuit. The first sub-display region s_AA, the second sub-display region s_AA2, the third sub-display region s_AA3 to the $i^{th}$ sub-display region s_AA1 extend along the y direction intersecting, for example perpendicular to, the x direction, respectively.

The first sub-display region s_AA1 includes 30 to 1000 rows of pixels, for example 100 rows of pixels (one sub-display region including only two rows of pixels is shown in FIG. 2-1 as an example). The second sub-display region s_AA2 adjacent to the first sub-display region s_AA1 also includes 30 to 1000 rows of pixels, for example, 100 rows of pixels, and so on. That is, each of the sub-display regions s_AA includes 30 to 1000 rows of pixels, for example, 100 rows of pixels.

As shown in FIG. 2-1, in a case where each of the sub-display regions s_AA includes a plurality of rows of pixels, when the data enable signal DE_o is at an active level with duration of t1 for the first time, the source driving circuit supplies data signals to 0 to 30 rows of pixels or 0 to 1000 rows of pixels (e.g. 100 rows of pixels) in the first sub-display region s_AA1 for a time t1. When the data enable signal DE_o is at the active level with duration of t2 for the second time, the source driving circuit supplies the data signals to the 30 to 1000 rows of pixels (e.g., 100 rows of pixels) in the second sub-display region s_AA 2 for a time t2. When the data enable signal DE_o is at the active level with duration of ti for the $i^{th}$ time, the source driving circuit supplies the data signals to 30 to 1000 rows of pixels (e.g., 100 rows of pixels) in the $i^{th}$ sub-display region s_AA1 for a time ti. Optionally, the active level is a high level, and the inactive level is a low level.

In an embodiment, as shown in FIG. 2-2, in a case where each of the sub-display regions s_AA includes only one row of pixels, when the data enable signal DE_o is at an active level with duration of t1 for the first time, the source driving circuit supplies data signals to a first row of pixels for a time t1. When the data enable signal DE_o is at an active level with duration of t2 for the second time, the source driving circuit supplies the data signals to the second row of pixels for a time t2, and so on. In a respective display period, when the data enable signal DE_o is at the active level with duration of ti for the $i^{th}$ time, the source driving circuit supplies the data signals to the $i^{th}$ row of pixels for a time ti. Optionally, the active level is a high level, and the inactive level is a low level.

Figure 3:
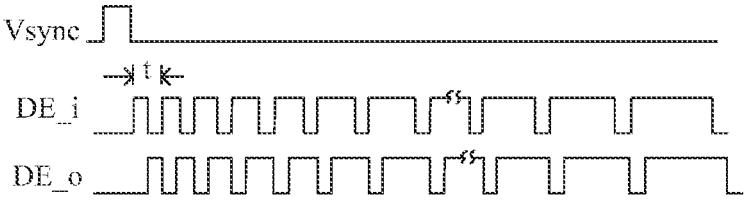
FIG. 3 is a timing diagram showing timings of a data enable signal received and output by a timing control circuit and a field sync signal according to an embodiment of the present disclosure.

The data enable signal may be provided to the timing control circuit by the system chip and provided to the source driving circuit by the timing control circuit. FIG. 3 is a timing diagram showing timings of a data enable signal received and output by the timing control circuit and a field sync signal Vsync. In FIG. 3, De_i represents a data enable signal received by the timing control circuit, and DE_o represents a data enable signal output by the timing control circuit to the source driving circuit. DE_o is delayed in time compared with De_i due to buffering of the signal in the timing control circuit.

Due to the voltage drop on the transmission line, when the source driving circuit supplies data signals to the pixels P in the sub-display regions s_AA to charge the pixels, the pixels P in the sub-display regions s_AA proximal to the source driving circuit are charged very fast, and the pixels P in the sub-display regions s_AA far away from the source driving circuit are charged slowly, so that when the source driving circuit charges the pixels P in different sub-display regions s_AA for the same time, the pixels P in the sub-display regions s_AA proximal to the source driving circuit are charged sufficiently, and the pixels P in the sub-display regions s_AA away from the source driving circuit are charged insufficiently. However, in the embodiment of the present disclosure, the duration of the active level of the data enable signal DE is positively correlated to a distance from the sub-display region s_AA where a respective row of pixels P are located to the source driving circuit rather than being fixed. Therefore, the farther the sub-display region s_AA is from the source driving circuit, the longer the source driving circuit charges pixels P in the sub-display region s_AA, therefore the pixels P away from the source driving circuit can be fully charged, thereby improving the uniformity of display.

In an embodiment, the duration of the active level of the data enable signal DE_o is positively correlated to a distance from a respective row of pixels P to the source driving circuit. That is to say, charging times for the source driving circuit to charge the rows of pixels P gradually increase along a direction gradually away from the source driving circuit (i.e., the x direction). That is, in respective display periods t, starting from the data enable signal reaching the active level for the second time, a current duration of the data enable signal at an active level is greater than a previous duration of the data enable signal at an active level.

The period in which the data enable signal DE_o has an inactive level is a line blanking period. Optionally, the time periods of the data enable signal DE_o at an inactive level are equal to each other, that is, the time periods of the line blanking periods are equal to each other.

The duration of the vertical blanking period may be set according to actual needs. The time when the data enable signal DE_o firstly reaches the active level during each display period may be determined according to the duration of the vertical blanking period.

Optionally, in the case where each of the sub-display regions includes only several rows of pixels, the durations of the data enable signal DE_o at an active level every time in respective display periods are calculated according to a preset correspondence between the durations of the active level and the numbers of the sub-display regions.

Optionally, in the case where each of the sub-display regions includes only one row of pixels, the durations of the data enable signal DE_o at an active level every time in respective display periods are calculated according to a preset correspondence between the durations of the active level and the numbers of rows of pixels.

The preset correspondence between the durations of the active level and the numbers of the sub-display regions, or the preset correspondence between the durations of the active level and the numbers of rows of pixels may be obtained by fitting method in a manner of data testing.

In an embodiment, when the preset correspondence between the durations of the active level of the data enable signal and the numbers of rows of pixels or the preset correspondence between the durations of the active level and the numbers of the sub-display regions obtained through data testing satisfies the curve: $y=f(x)$ in FIG. 4, the display uniformity of the display panel can be improved.

Figure 4:
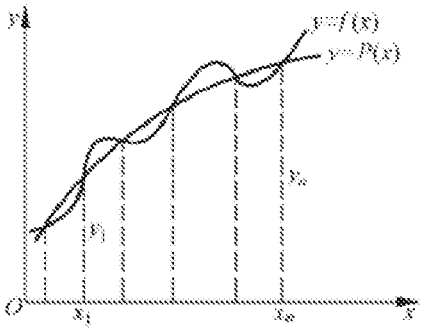
FIG. 4 is a graph showing a relationship between a duration of an active level of a data enable signal and a number of a sub-display region or a number of rows of pixels according to an embodiment of the present disclosure.

Referring to FIGS. 2-1 and 4, when each of the sub-display regions includes a plurality of rows of pixels, a vertical axis represents the duration of the active level, and the horizontal axis represents the number of the sub-display region. That is, the duration of the data enable signal at a high level for the $x_1^{th}$ time is a time $y_1$, and the source driving circuit charges the pixels in the rows in the $x_1^{th}$ sub-display region for a time $y_1=f(x_1)$ when the data enable signal is at a high level for the $x_1^{th}$ time.

When the curve of $y=f(x)$ is a complex function curve, $y=f(x)$ may be replaced with a smoothed curve $y=P(x)$ constructed by means of a best approximation method. The curve $y=P(x)$ is a parabolic equation, and represents the preset correspondence between the durations of the active level and the numbers of the sub-display regions. Each of the durations of the data enable signal at an active level may be calculated according to the preset correspondence between the durations of the active level and the numbers of the sub-display regions, thereby providing the optimal charging duration for each of the sub-display regions, facilitating the realization of the hardware, and reducing the consumption of hardware resources.

In another embodiment, referring to FIGS. 2-2 and 4, when each of the sub-display regions includes only one row of pixels, the vertical axis represents the duration of the active level, and the horizontal axis represents the number of rows. That is, the duration in which the data enable signal is at the high level for the $x_1^{th}$ time is $y_1$, and the source driving circuit charges the pixels in the $x_1^{th}$ row for a time $y_1=f(x_1)$ when the data enable signal is at a high level for the $x_1^{th}$ time.

When the curve of $y=f(x)$ is a complex function curve, $y=f(x)$ may be replaced with a smoothed curve $y=P(x)$ constructed by means of a best approximation method. The curve $y=P(x)$ is a parabolic equation, and represents the preset correspondence between the durations of the active level and the numbers of rows of pixels. The durations of the data enable signal at an active level every time may be calculated according to the preset correspondence between the durations of the active level and the numbers of rows of pixels, thereby providing the optimal charging duration for each of the sub-display regions, facilitating the realization of the hardware, and reducing the consumption of hardware resources.

It should be noted that, in the embodiment, the durations in which the source driving circuit charges each of the sub-display regions change gradually, and accordingly durations in which the gate driving circuit charges each of the sub-display regions change gradually, that is, a clock signal supplied to the gate driving circuit is not a signal with a fixed period anymore.

Figure 5:
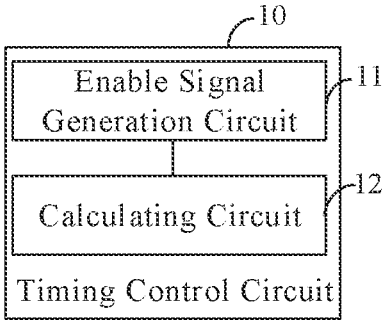
FIG. 5 is a schematic diagram showing a structure of a timing control circuit of a display panel according to an embodiment of the present disclosure.

FIG. 5 is a schematic diagram showing a structure of a timing control circuit of a display panel according to an embodiment of the present disclosure. A display region of the display panel is divided into a plurality of sub-display regions arranged along an x direction away from a source driving circuit and each extending along a y direction intersecting the x direction. Each of the sub-display regions includes at least one row of pixels.

As shown in FIG. 5, the timing control circuit 10 includes: an enable signal generation circuit 11 configured to supply a data enable signal to a source driving circuit in respective display periods. The source driving circuit supplies data signals to the plurality of sub-display regions under control of the data enable signal. The data enable signal is switched between an active level and an inactive level, and the active levels are in one-to-one correspondence with the plurality of sub-display regions. The duration of the data enable signal at an active level increases as a distance from the sub-display region in which a respective row of pixels are located to the source driving circuit increases. In an embodiment, the farther a distance from a sub-display region to the source driving circuit is, the longer the duration, at an active level, of the data enable signal for controlling the source driving circuit to supply the data signals to the at least one row of pixels in the sub-display region.

Optionally, the time periods in which the data enable signal is at an inactive level are equal to each other.

Optionally, the timing control circuit 10 further includes: a calculating circuit 12 configured to calculate, according to a preset correspondence between the durations of the data enable signal at an active level and the numbers of the sub-display regions, each of the durations of the data enable signal at an active level.

Optionally, the preset correspondence satisfies a parabolic equation after being fitting by best approximation method.

Optionally, each of the plurality of sub-display regions has 30 to 1000 rows of pixels, alternatively, each of the sub-display regions has only one row of pixels.

Optionally, the duration in which the data enable signal is at an active level is positively correlated with a distance from a respective row of pixels to the source driving circuit.

Figure 6:
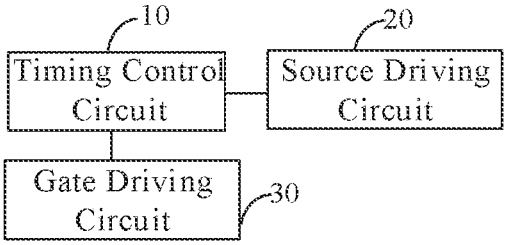
FIG. 6 is a schematic diagram showing a structure of a driving device according to an embodiment of the present disclosure.

FIG. 6 is a schematic diagram showing a structure of a driving device according to an embodiment of the present disclosure. As shown in FIG. 6, the driving device includes the timing control circuit 10 and the source driving circuit 20 according to the above embodiment of the present disclosure. The source driving circuit 20 is configured to supply data signals to at least one row of pixels in a respective sub-display region when the data enable signal is at a high level.

In addition, the driving device further includes a gate driving circuit 30 configured to supply a scanning signal to pixels row by row under the control of the timing control circuit 10, so as to scan the pixels row by row. The source driving circuit 20 may supply the data signals to the sub-display regions during the scanning period of the pixels.

It can be seen that, in the embodiments, the duration of the active level of the data enable signal DE is positively correlated to a distance from the sub-display region s_AA where a respective row of pixels P are located to the source driving circuit rather than being fixed. Therefore, the farther a sub-display region s_AA is from the source driving circuit, the longer the source driving circuit charges pixels in the sub-display region s_AA, therefore the pixels P away from the source driving circuit can be fully charged, thereby improving the uniformity of display.

It should be noted that the calculating circuit may be implemented by hardware, software, or a combination of hardware and software. In an embodiment, the calculating circuit may be implemented by a processor or integrated circuit having associated functionality, where the processor may execute software or instructions implementing the functionality of the respective circuits. In another embodiment, the calculating circuit may be implemented by a computer memory and a program stored in the computer memory and the processor executes the program to realize the calculation circuit, the memory having stored therein with program for calculating the durations of the data enable signal at an active level in respective display periods according to the preset correspondence between the durations of the active level of the data enable signal and the numbers of the plurality of sub-display regions.

The present disclosure also provides a display device including the above driving device. The display device may be any product or component with a display function, such as a display, a television, a tablet computer, a digital photo frame, a navigator and the like.

It should be understood that the above implementations are merely exemplary embodiments for the purpose of illustrating the principles of the present disclosure, however, the present disclosure is not limited thereto. It will be apparent to those skilled in the art that various changes and modifications can be made without departing from the spirit and essence of the present disclosure, which are also to be regarded as the scope of the present disclosure.

What is claimed is:

1. A timing control method for a display panel, a display region of the display panel being divided into a plurality of sub-display regions arranged along a first direction away from a source driving circuit and extending along a second direction intersecting the first direction, and each of the plurality of sub-display regions comprising at least one row of pixels, the timing control method comprising:

supplying a data enable signal to the source driving circuit in respective display periods, such that the source driving circuit supplies a data signal to the plurality of sub-display regions under control of the data enable signal; wherein the data enable signal is switched between an active level and an inactive level; the data enable signal has a plurality of time periods at an active level, the plurality of time periods at an active level being in one-to-one correspondence with the plurality of sub-display regions of the display panel; and the greater a distance from a sub-display region of the plurality of sub-display regions to the source driving circuit is, the longer a time period, at an active level, of the data enable signal is, the data enable signal being configured to control the source driving circuit to provide the data signal to the at least one row of pixels in the sub-display region.

2. The timing control method according to claim 1, wherein each of the plurality of time periods of the data enable signal at an active level in the respective display periods is calculated according to a preset correspondence between the time periods of the data enable signal at an active level and numbers of the plurality of sub-display regions.

3. The timing control method according to claim 2, wherein after the preset correspondence is fitted by a best approximation method, the fitted preset correspondence satisfies a parabolic equation.

4. The timing control method according to claim 1, wherein time periods of the data enable signal at an inactive level are equal to each other.

5. The timing control method according to claim 1, wherein each of the plurality of sub-display regions comprises 30 to 1000 rows of pixels.

6. The timing control method according to claim 1, wherein each of the plurality of sub-display regions comprises only one row of pixels.

7. A timing control circuit for a display panel, a display region of the display panel being divided into a plurality of sub-display regions arranged along a first direction away from a source driving circuit and extending along a second direction intersecting the first direction, and each of the plurality of sub-display regions comprising at least one row of pixels, the timing control circuit comprising:

an enable signal generation circuit configured to supply a data enable signal to the source driving circuit in respective display periods, such that the source driving circuit supplies a data signal to the plurality of sub-display regions under control of the data enable signal; wherein the data enable signal is switched between an active level and an inactive level; and the data enable signal has a plurality of time periods at an active level, the plurality of time periods at an active level being in one-to-one correspondence with the plurality of sub-display regions of the display panel; the farther a distance from a sub-display region of the plurality of sub-display regions to the source driving circuit is, the longer a time period, at an active level, of the data enable signal is, the data enable signal being configured to control the source driving circuit to provide the data signal to the at least one row of pixels in the sub-display region.

8. The timing control circuit according to claim 7, further comprising a calculating circuit configured to calculate each of the plurality of time periods of the data enable signal at an active level in the respective display periods according to a preset correspondence between the time periods of the data enable signal at an active level and numbers of the plurality of sub-display regions.

9. The timing control circuit according to claim 8, wherein after the preset correspondence is fitted by a best approximation method, the fitted preset correspondence satisfies a parabolic equation.

10. The timing control circuit according to claim 7, wherein time periods of the data enable signal at an inactive level are equal to each other.

11. The timing control circuit according to claim 7, wherein each of the plurality of sub-display regions comprises 30 to 1000 rows of pixels.

12. The timing control circuit according to claim 7, wherein each of the plurality of sub-display regions comprises only one row of pixels.

13. A display device, comprising a timing control circuit for a display panel, a display region of the display panel being divided into a plurality of sub-display regions arranged along a first direction away from a source driving circuit and extending along a second direction intersecting the first direction, and each of the plurality of sub-display regions comprising at least one row of pixels, the timing control circuit comprising:

an enable signal generation circuit configured to supply a data enable signal to the source driving circuit in respective display periods, such that the source driving circuit supplies a data signal to the plurality of sub-display regions under control of the data enable signal; wherein the data enable signal is switched between an active level and an inactive level; and the data enable signal has a plurality of time periods at an active level, the plurality of time periods at an active level being in one-to-one correspondence with the plurality of sub-display regions of the display panel; the farther a distance from a sub-display region of the plurality of sub-display regions to the source driving circuit is, the longer a time period, at an active level, of the data enable signal is, the data enable signal being configured to control the source driving circuit to provide the data signal to the at least one row of pixels in the sub-display region.

14. The timing control method according to claim 2, wherein time periods of the data enable signal at an inactive level are equal to each other.

15. The timing control method according to claim 3, wherein time periods of the data enable signal at an inactive level are equal to each other.

16. The timing control circuit according to claim 8, wherein time periods of the data enable signal at an inactive level are equal to each other.

17. The timing control circuit according to claim 9, wherein time periods of the data enable signal at an inactive level are equal to each other.

* * * * *